United States Patent [19]

Menchetti

[11] Patent Number: 4,693,047

[45] Date of Patent: Sep. 15, 1987

[54] BENDABLE CHANNEL RETAINER

[75] Inventor: Robert J. Menchetti, Buffalo, N.Y.

[73] Assignee: National Gypsum Company, Dallas, Tex.

[21] Appl. No.: 880,592

[22] Filed: Jun. 30, 1986

[51] Int. Cl.[4] ..... E04H 1/00; A43B 23/20

[52] U.S. Cl. ..... 52/664; 52/241; 52/481; 52/721

[58] Field of Search ..... 52/664, 667, 721, 241, 52/481, 486, 489

[56] References Cited

U.S. PATENT DOCUMENTS

| | | | |
|---|---|---|---|
| 1,184,309 | 5/1916 | Berson | 52/667 |
| 1,346,426 | 7/1920 | Scherbner | 52/667 |
| 2,640,570 | 6/1953 | Horowitz | 52/667 |
| 3,177,990 | 4/1965 | Flucker et al. | 52/667 |
| 4,128,979 | 12/1978 | Price | 52/241 |
| 4,222,211 | 9/1980 | Pearson | 52/241 X |
| 4,329,820 | 5/1982 | Wendt | 52/241 |
| 4,448,004 | 5/1984 | Thorsell | 52/667 |

*Primary Examiner*—J. Karl Bell

*Attorney, Agent, or Firm*—Robert F. Hause

[57] ABSTRACT

A wall framework consisting essentially of vertical studs formed of sheet metal and horizontal channels extending through openings in the webs of the studs and locked firmly in the bottom portion of each opening by bendable sheet metal tabs formed at the sides of the upper portion of each opening, which tabs, when bent relatively inwardly, engage and hold the channel firmly in a desired position.

16 Claims, 5 Drawing Figures

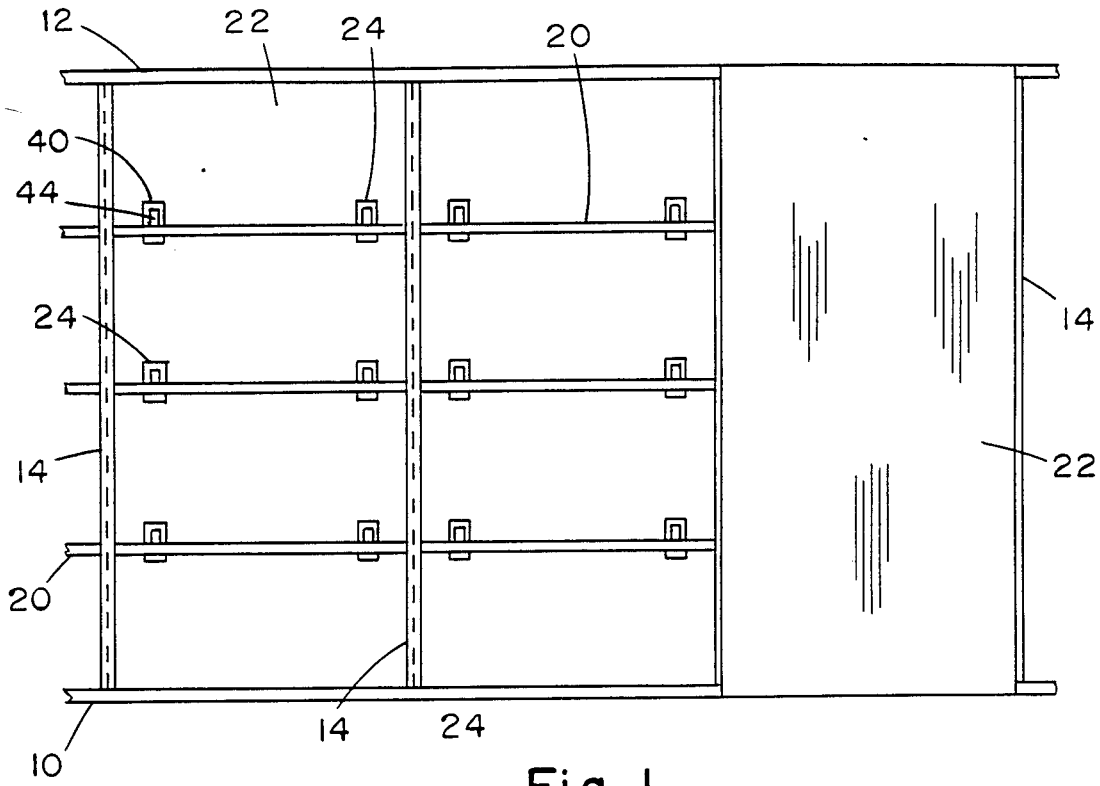
Fig. 1
Fig. 3
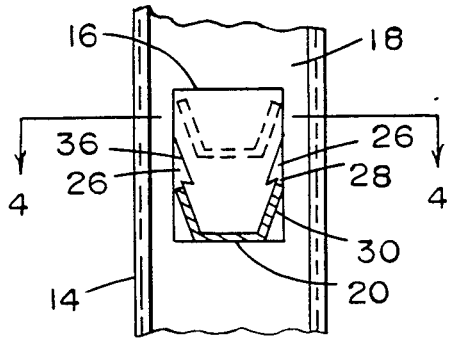
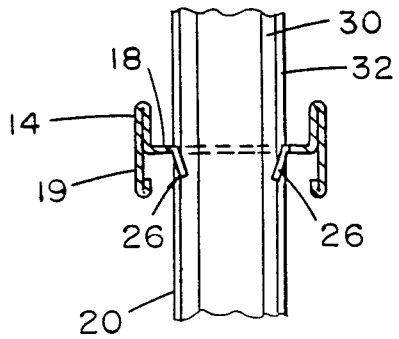
Fig. 4
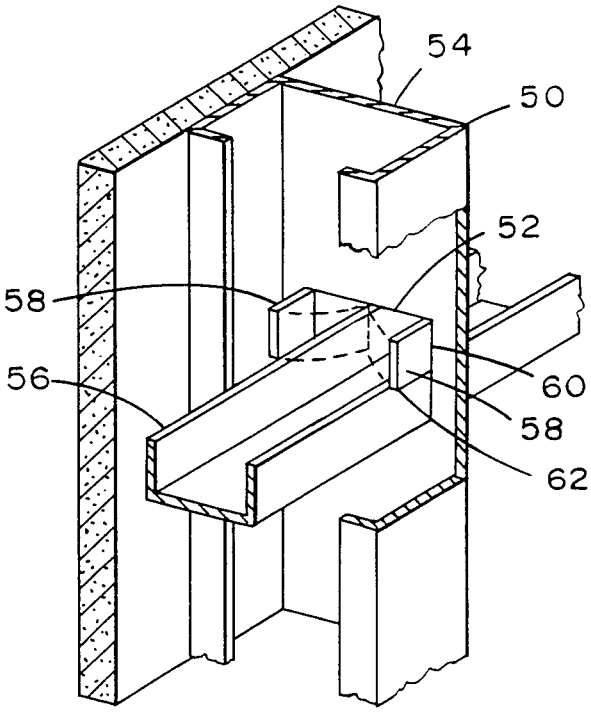
Fig. 5

BENDABLE CHANNEL RETAINER

BACKGROUND OF THE INVENTION

This invention relates to an improved metal stud for use in combination with horizontal channels for stiffening a vertical wall framework, and, in particular, to a stud having an opening in the stud web for reception of a horizontal channel and having bendable means at the side of the opening for stabilizing the channel relative to the stud.

This invention is particularly advantageous in removable partition walls generally similar to those shown in U.S. Pat. No. 4,448,004, wherein gypsum wallboard panels are suspended from horizontal channels and the horizontal channels are extended through cut-outs or openings in the webs of the vertical metal studs. In accordance with the invention in U.S. Pat. No. 4,448,004, the cut-outs are shaped in a way that permits a special shaped channel to be inserted into the cut-outs of a plurality of studs and then rotated 90° causing the special shaped channel to bend slightly and then become locked under a pair of shoulders on the sides of the cut-out.

SUMMARY OF THE INVENTION

The present invention provides an improvement in a removable partition wall of the type wherein a horizontal channel is mounted to extend through a plurality of openings in the webs of a plurality of vertically mounted metal studs. The openings in the stud webs are formed with bendable portions hingedly affixed to the balance of the metal of the stud web, which hinged portions are formed to be bent inwardly from the side into the opening to engage and stabilize the channel relative to the stud and the stud web.

In a preferred embodiment of the invention the hinged portions are normally disposed at an angle to the plane of the stud web such that channels, rectangular shaped, V-shaped or of an angled side and flatter bottom shape, can be inserted through the openings and snapped under the bottom edge of the hinged portion, where a roughened bottom edge on the hinged portion springs back into the opening area, over the channel edge, to provide improved engagement and stabilization of the channel.

It is an object of the present invention to provide an improved stabilized interconnection of a horizontal metal channel and a stud web opening through which the channel extends.

It is a further object to provide a stud web opening having bendable hinged portions at the side of the opening disposed for engaging and stabilizing a channel extending through the opening when the hinged portions are bent into the opening to engage the channel.

BRIEF DESCRIPTION OF THE DRAWINGS

These and other objects and advantages of the invention will be more readily apparent when considered in relation to the preferred embodiments as set forth in the specification and shown in the drawings in which:

FIG. 1 is a side view of a partition wall system, with some panels removed, revealing the framework which is suitable for construction in accordance with the invention.

FIG. 3 is a vertical section of the stud of FIG. 2 showing the channel in broken lines as first placed in the stud openings and in solid lines as it is confined in its final position.

FIG. 4 is a horizontal sectional view taken on line 4—4 of FIG. 3.

FIG. 5 is an isometric view of a modification of the support structure of the invention, showing a horizontal channel in final position, with a pair of bendable tabs formed on each side of the stud web opening, with broken lines showing the bending in of the tabs and locking of the channel.

DESCRIPTION OF THE PREFERRED EMBODIMENTS

Figure 2:
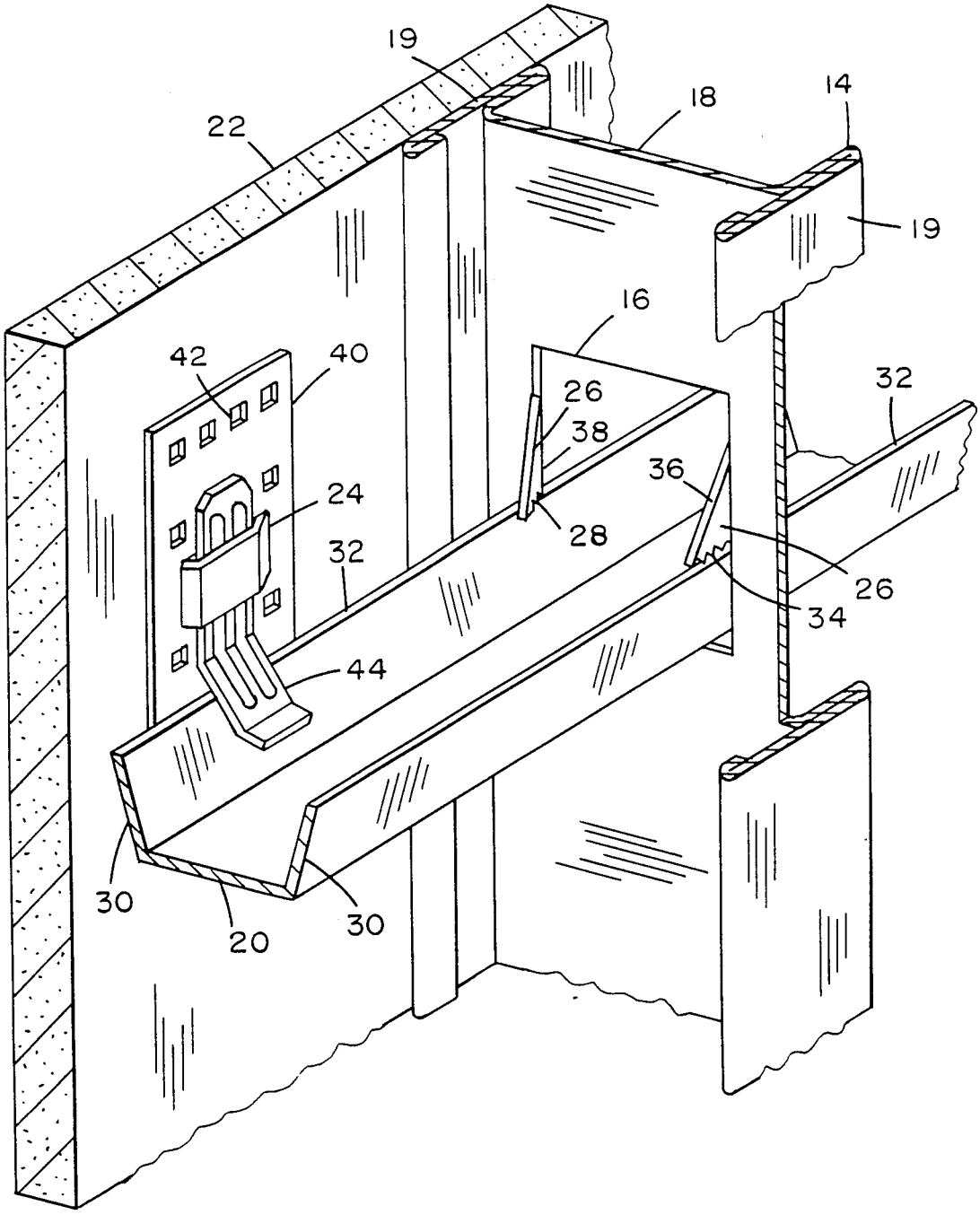
FIG. 2 is an isometric view of the support structure of the present invention showing the horizontal channel seated and confined in the opening in the vertical stud web, in accordance with the invention.

Referring to FIGS. 1–4, a support framework is provided which includes channel-like runners 10,12 mounted on the floor and ceiling respectively. Extending between these runners are laterally spaced vertical metal studs 14. Horizontally aligned cutouts or openings 16 are formed in the webs 18 of the studs 14, through which horizontal channels 20 are extended. Gypsum board panels 22 are suspended from the horizontal channels 20 by suspension assemblies 24 affixed to the rear faces of the panels.

The vertical studs 14 have an I-shaped cross-section in this preferred embodiment shown, however, metal studs of other configurations, such as a C-shaped cross-section, can be used also, provided the stud includes a central web 18 wherein the cut-outs or openings 16 can be formed and face portions 19 on each side to which panels 22 are abutted. The openings 16 have a width which is equal to the width of the channels 20 and a height which is at least twice the height of the channels 20.

In accordance with the invention, the openings 16 each have a pair of bendable tabs 26 formed in the upper periphery thereof. The bendable tabs 26, in the preferred embodiment, are made in the form of a small section of the stud web sheet metal which in a horizontal sectional view, FIG. 4, will be seen to be at an angle of about 110° to the plane of the stud web 18, and in a vertical sectional view, FIG. 3, will be seen to have a bottom edge 28 extending inwardly and upwardly at an angle of about 15° from horizontal. Tab 26 have a width at their bottom edge 28 of about $\frac{3}{8}$ inch, but, being bent sharply out of the plane of the stud web 18, the tabs extend only about $\frac{1}{8}$ inch into the area of the opening as seen in FIG. 3.

The bottom edge 28 of each tab 26 is located immediately atop one of the two upwardly extending sides 30 of channel 20, with the top 32 of each side 30 firmly engaging one of the two bottom edges 28, at about the mid point of the bottom edge 28. Bottom edge 28 is preferably lightly serrated with teeth 34 to more firmly grasp the channel side 30.

The upper portion of each tab 26 has an edge 36 which is tapered upward, and each tab 26 is hingedly connected to web 18 along a vertical fold 38, on each side of opening 16.

The preferred form of channel 20 for use with opening 16 and tabs 26 is C-shaped with sides angled upwardly and slightly outwardly, at an angle corresponding approximately to the angle of the tab upper edges 36. Placement of the channels 20 in a locked condition is openings 16 involves extending the channel 20 through the upper area of a plurality of parallel vertical stud openings 16, with the channel opening upwardly, and forcing the channel straight down causing the tabs 26 to bend outwardly and then return to the position described hereinabove, with the bottom edges 28 locking the channel 20 in the lower portion of the openings 16.

The thickness of the metal of the channel 20 is greater than the thickness of the metal in the stud 14, the channel being of about 0.035 inch thickness and the stud being of about 0.025 inch thickness. The channel dimensions are about $1\frac{1}{2}$ inch wide by $\frac{3}{4}$ inch high. The studs are an I-shape, about $2\frac{1}{2}$ inches wide and about $1\frac{1}{4}$ inch deep.

The suspension assemblies 24 suspending the gypsum board panels 22 are the subject matter of U.S. Pat. No. 4,128,979 and will be only briefly described herein. Each suspension assembly 24 comprises a gang nail plate 40 affixed by tangs 42 driven into the rear face of the panel 22. A removable hanger member in the form of a spring clip 44 is attached to the gang nail plate 40. The lower portion of the clip 44 is inclined downwardly and away from the plane of the plate 40 and engages one of the sides 30 of the channel 20, to suspend a panel 22 therefrom.

Referring to FIG. 5, there is shown a modification of the invention in which a C-shaped stud 50 has an opening 52 in the web 54. A horizontal channel 56 is locked in the bottom of the opening 52 by a pair of bendable tabs 58 each hingedly connected to web 54 along one side at a fold 60 in the sheet metal. Studs 50 are manufactured and sold with the tabs 58 bent inwardly at an angle of about 90°. After a channel 56 is placed through the opening 52, and moved to the bottom of the opening, the two opposed tabs 58 are bent along the fold 60 adjoining each tab 50 to the web 54, as shown by the broken lines. The tabs 58 have a bottom edge 62 spaced from the bottom of opening 52, an amount such that the channel is locked tightly in place by the tab bottom 62.

In summary, the present invention contemplates the stabilization of horizontal channels disposed within openings in the webs of vertical metal studs, using a bendable tab formed to be bendable horizontally into the area of the opening to firmly engage the channel and retain the channel in a fixed position.

Having completed a detailed disclosure of the preferred embodiments of our invention, so that those skilled in the art may practice the same, we contemplate that variations may be made without departing from the essence of the invention.

I claim:

1. A vertical metal stud comprising a pair of opposed face portions and a central web, said web having a plurality of openings for the reception of horizontal channels therethrough, said web openings having a pair of bendable tabs hingedly formed at the two sides of the upper portion of said web opening positioned to firmly abut and restrain a channel in the lower portion of said web opening when said tabs are in an inwardly bent position, said bendable tabs being hingedly bendable to an outwardly bent position sufficient to permit movement of an upwardly opening channel from the upper portion of said web opening to a firm upwardly opening channel position in the lower portion of said web opening.

2. A vertical metal stud as defined in claim 1, said tabs are disposed at an angle of about 110° from the plane of said central web, whereby said tabs are bendable to about 90° from the plane of said central web during the process of placing a channel in said firm position in the lower portion of said opening and retain a tendency to return to said opening about 110° disposition immediately following completion of said placing.

3. A vertical metal stud as defined in claim 2 wherein said tabs each have a bottom edge which extends inwardly and upwardly at an angle of about 15° from horizontal.

4. A vertical metal stud as defined in claim 3 wherein said bottom edge is serrated.

5. A vertical metal stud as defined in claim 2 wherein said tabs have a width of about $\frac{3}{8}$ inch and extend into said opening about $\frac{1}{8}$ inch.

6. A vertical metal stud as defined in claim 2 wherein said tabs are tapered from a relatively wide bottom to a narrower top.

7. A vertical metal stud as defined in claim 6 wherein said tabs each have a bottom edge which extends inwardly and upwardly at an angle of about 15° from horizontal which is serrated, and said tabs have a width of about $\frac{3}{8}$ inch near the bottom tapering upwardly to a relatively narrower top and extend into said opening about $\frac{1}{8}$ inch.

8. A vertical metal stud as defined in claim 1, said tabs being rectangular whereby said tabs require manual bending to restrain a channel in the lower portion of said opening.

9. A vertical metal stud as defined in claim 1 wherein said stud has an I-shaped cross-section.

10. A vertical metal stud as defined in claim 9 wherein said stud is about $2\frac{1}{2}$ inches wide and about $1\frac{1}{4}$ inch deep.

11. A vertical wall framework comprising a plurality of vertical studs as defined in claim 1 and a plurality of vertical metal channels, said channels extending through said openings in the webs of a plurality of said studs, said channels being firmly held in the lower portion of said openings by said pair of bendable tabs.

12. A vertical wall framework as defined in claim 11 wherein said tabs are disposed at an angle of about 110° from the plane of said central web.

13. A vertical wall framework as defined in claim 12 wherein said tabs each have a bottom edge which extends inwardly and upwardly at an angle of about 15° from horizontal which is serrated, and said tabs have a width of about $\frac{3}{8}$ inch near the bottom tapering upwardly to a relatively narrower top and extend into said opening about $\frac{1}{8}$ inch.

14. A vertical wall framework as defined in claim 11 wherein said stud has an I-shaped cross-section.

15. The method of locking a horizontal channel firmly within openings in the central web of a vertical metal stud comprising the steps of forming at least one, horizontally bendable tab in a side of the upper portion of an opening through the central web of a vertical metal stud, disposing a horizontal metal channel through said upper portion of said opening with the channel opening directed upwardly, moving said horizontal channel to the lower portion of said opening while maintaining said channel opening in said upwardly opening direction and locking said horizontal channel into said lower portion by the bending of said bendable tab to an angle substantially greater than 90° to the plane of said central web.

16. The method of claim 15 wherein said tabs are disposed one on each side of said opening at an angle of about 110° from the plane of said central web just prior to disposing said channel through said opening, and wherein said tabs are caused to bend to an angle of about 90° from the plane of said central web by the channel being moved into the opening and downward to the lower portion of said opening, and wherein said tabs are allowed to spring back toward said original 110° angle after finally positioning said channel, whereby said tabs hold said channel firmly in said opening lower portion.

* * * * *